US008708760B2

(12) United States Patent
Davis et al.

(10) Patent No.: US 8,708,760 B2
(45) Date of Patent: Apr. 29, 2014

(54) TRIMMABLE POD DRIVE

(75) Inventors: Eric A. Davis, Mequon, WI (US); Richard A. Davis, Mequon, WI (US)

(73) Assignee: Davis Engineering, LLC, Mequon, WI (US)

( * ) Notice: Subject to any disclaimer, the term of this patent is extended or adjusted under 35 U.S.C. 154(b) by 195 days.

(21) Appl. No.: 13/026,080

(22) Filed: Feb. 11, 2011

(65) Prior Publication Data

US 2011/0195619 A1 Aug. 11, 2011

Related U.S. Application Data

(60) Provisional application No. 61/303,513, filed on Feb. 11, 2010, provisional application No. 61/337,631, filed on Feb. 11, 2010.

(51) Int. Cl.
*B63H 5/125* (2006.01)

(52) U.S. Cl.
USPC ..... 440/61 T; 440/53; 440/61 S; 440/75; 440/112

(58) Field of Classification Search
USPC ..... 440/53, 55, 56, 57, 61 R, 61 S, 75, 111, 440/112, 61 T
See application file for complete search history.

(56) References Cited

U.S. PATENT DOCUMENTS

| | | | | |
|---|---|---|---|---|
| 4,408,994 | A | 10/1983 | Blanchard | |
| 4,559,018 | A | 12/1985 | Nakahama et al. | |
| 4,600,395 | A | 7/1986 | Pichl | |
| 4,907,994 | A | 3/1990 | Jones | |
| 5,108,325 | A | 4/1992 | Livingston et al. | |
| 6,390,866 | B1 | 5/2002 | Nystrom | |
| 6,561,859 | B1 * | 5/2003 | Towner et al. | 440/61 S |
| 6,609,939 | B1 * | 8/2003 | Towner et al. | 440/111 |
| 8,011,983 | B1 * | 9/2011 | Davis et al. | 440/56 |

(Continued)

FOREIGN PATENT DOCUMENTS

| | | | |
|---|---|---|---|
| DE | 102007048058 | A1 | 4/2009 |
| EP | 1775212 | A2 | 4/2007 |

(Continued)

OTHER PUBLICATIONS

Notification of Transmittal of International Search Report and Written Opinion of International Searching Authority; International Application No. PCT/US2011/024660; Jul. 25, 2011; 12 pages.

(Continued)

*Primary Examiner* — Lars A Olson
(74) *Attorney, Agent, or Firm* — Whyte Hirschboeck Dudek S.C.

(57) ABSTRACT

Disclosed herein is a trimmable pod drive assembly that includes a pod drive unit having a transmission assembly secured to a steering unit, a gear case assembly coupled to and rotatable by the steering unit about a steering axis, and a propeller rotatable about a propeller driveshaft axis extending through the gear case assembly so as to generate thrust along a thrust vector. The trimmable pod drive assembly further includes a trim assembly secured to the pod drive unit in a manner allowing for rotation of the pod drive unit about a trim axis that is substantially perpendicular to the steering axis, wherein actuation of at least one component of the trim assembly causes movement of the pod drive unit and the thrust vector about the trim axis.

17 Claims, 15 Drawing Sheets

(56) References Cited

U.S. PATENT DOCUMENTS

| | | | |
|---|---|---|---|
| 2006/0052014 | A1 | 3/2006 | Kobayashi |
| 2006/0172630 | A1 | 8/2006 | Kawamoto |
| 2009/0203271 | A1 | 8/2009 | Okabe et al. |

FOREIGN PATENT DOCUMENTS

| | | | |
|---|---|---|---|
| EP | 1777154 | A2 | 4/2007 |
| FR | 2939403 | A1 | 6/2010 |
| WO | 2009075623 | A1 | 6/2009 |

OTHER PUBLICATIONS

Notification of Transmittal of International Search Report and Written Opinion of International Searching Authority; International Application No. PCT/US2011/024648; Aug. 1, 2011; 11 pages.

* cited by examiner

TRIMMABLE POD DRIVE

CROSS-REFERENCE TO RELATED APPLICATIONS

The present Application claims the benefit of U.S. provisional patent application No. 61/303,513 filed on Feb. 11, 2010 and entitled "Trimable Pod Drive", and U.S. provisional patent application No. 61/337,631 filed on Feb. 11, 2010 and entitled "Trimable Pod Drive", which are hereby incorporated by reference herein.

FIELD OF THE INVENTION

The trimmable pod drive relates to marine vessel pod drive units.

BACKGROUND OF THE INVENTION

Modern inboard boat technology includes several types of drive units that are suitable for providing propulsion to large marine vessels, namely, inboard-fixed strut drive and pod drive. Both drive units are similar in that an engine is rigidly mounted inside the vessel to a hull structure (a.k.a. stringer system) along the hull, and a drive or shaft system is also rigidly mounted separately to the hull so that power can be applied through the shaft system and the resulting propulsive forces can be channeled through the hull structure to propel the vessel.

The inboard-fixed strut drive system includes an engine powering a transmission that is coupled with a propeller shaft having a propeller at an end. In the fixed strut system, the propeller shaft is in a "fixed" position about the vessel bottom, preventing any horizontal or vertical changes relative to the bottom of the hull. Therefore, the vessel operates at all times with the propeller shaft rotating only about its longitudinal axis for propulsion. This system prevents the inboard-fixed strut drive from providing any vessel steering capability and therefore a rudder system is required to steer the vessel.

The pod drive, also known as Azi-pods, were traditionally self contained power units (usually electric), and in contrast to the inboard-fixed strut drive, each pod could "Azimuth" or change steering angles in order to direct thrust (propulsion) or vector the thrust at any desired steering angle. With the Azi-pod, a structure holds the drive to the vessel in a manner that constrains the drive to steer about a fixed steering axis. Although the drive may be allowed to steer through 360 degrees along its steering axis, the steering axis is fixed to the hull and cannot be altered. Therefore, the Azi-pod drive has a steering axis and thrust vectors that are fixed substantially 90 degrees or orthogonally located relative to the underlying vessel bottom surface.

Eventually, a variant of the pod drive was introduced that utilized an engine and transmission mounted outside the pod. As the engine mounting and the pod mounting are separate, the pod mounting allows all the propulsive force to be transmitted directly into the stringer system. In this configuration, a steering axis is created and constrained by a "well" that is constructed inside the stringer system extending through the vessel bottom. The pod drive is then contained and sealed with a double O-ring system that is forcibly held inside the well with a clamp ring. All propulsive and steering forces are transmitted through this O-ring-well system. The steering axis is substantially perpendicular to the vessel bottom or the dihedral angles of the vessel bottom; therefore the pod drive is constrained to steer on the dihedral angle of the vessel bottom. When this drive is mounted to a point where the vessel bottom is not horizontal, this configuration introduces a proportional vertical component of thrust as the pod drive is steered about the steering axis. Additionally, a single piece grommet that constrains and seals the pod about the vessel bottom can be used instead of the O-ring system.

Current inboard boats are controlled on the three axes of freedom, yaw, pitch, and roll, by two systems acting independently, the steering system and the trim system. Both the pod and inboard-fixed shaft drive units can utilize trim tabs to control vessel pitch (trim). The trim tabs can be fixed directly onto the pod or mounted to the stern of the vessel. In addition, or in place of the trim tab, an interceptor can be utilized to provide pitch control. Trim tabs or interceptor blades are typically fastened to the stern of the vessel at the intersection of the bottom surface of the vessel and the stern. The trim tab and interceptor devices are deployed downward at the surface of the water immediately leaving the bottom of the vessel. This downward motion causes a positive upstream pressure to react on the device and the vessel bottom immediately adjacent to the device. This positive pressure causes a lift reaction that raises the stern of the vessel while underway. This stern lift is the control of pitch for inboard planing hulls. Exerting the device against the surface of the water creates a parasitic drag force that reduces thrust efficiency and vessel speed.

As with the trim tab, the use of two pod drives can provide another method of pitch control, although it is also problematic. More particularly, pitch control could be provided when a pod drive is mounted on the port side of a hull that is not horizontal, for example 20 degrees off the horizontal, and another pod drive is mounted on the starboard side which is also 20 degrees off the horizontal, such that their steering axes are angled towards each other and are not vertical. In this case, if both drives are "toed in" such that the vertical thrust components would be added to create a slight net downward force on the stern. If the drives were "toed out," a net upward force would be created tending to lift the stern. Therefore, pitch control could be gained by a dynamic toe adjustment inward or outward. (Toe adjustment is described as an adjustment from dead forward on both drives of equal magnitude causing the leading point of the gear cases (about the front of the pod) to be closer (toe in) or farther (toe out) apart). Although pitch control can be obtained in this manner, a practical problem with this method of trim is that in order to trim the vessel, forward thrust must be attenuated. Additionally, toeing the gear cases causes increased drag. Moving the thrust vector away from dead forward, and increasing the drag of the drive system, as described to attain trim has an attenuating effect on total forward thrust. Therefore, this method may be just as inefficient or possibly even worse than using trim tab or interceptor methodology.

Adjustment of the pitch (trimming) of a vessel has a substantial effect on the efficiency of the planing boat hull. Recreation marine craft (smaller vessels) for the most part use a planing hull, as these best fulfill the market desire to achieve speeds in excess of 30-40-50 mph. For these speeds, vessel hulls from 12 feet in length to 50 feet in length are designed to be planing hulls. This method requires the least power for the most speed as the vessel is "skimming" over the water as compared to "plowing" through the water as in the case of very large vessels. The dynamic of a planing hull is that it has two states, off-plane and on-plane. The state of the hull dynamic is directly proportional to the speed of the hull in the forward direction. In the off-plane speed range, the vessel is viewed as a displacement hull (like a very large vessel). In this case, the longitudinal keel line is parallel to the keel line when the boat is at rest. As speed is increased, the bow of the vessel rises due to increasing water pressure from speeding forward, causing the wetted surfaces to move aft. As this tendency continues, the wetted surface will move far enough aft until the center of gravity of the vessel causes the vessel to "fall forward" into the planing position.

The stable planing attitude for most hulls will be 4 to 5 degrees bow up compared to the horizontal. In the inboard-fixed drive, the inboard thrust vector is in line with the propeller shaft, which is usually upward at 10 to 13 degrees. With the pod drives, the thrust vector is substantially horizontal (0 degrees). Therefore, when the hulls are on plane at 4 to 5 degrees above the horizontal, this must be added to the fixed thrust angle to understand the dynamic planing state. Thus, the planing inboard-fixed drive thrust angle would range from 14 degrees to 18 degrees above horizontal where the pod drives would be 4 to 5 degrees above horizontal. As the thrust in the horizontal plane causes forward motion, these angles above the horizontal cause the attenuation of forward thrust by the cosine of the angle.

BRIEF SUMMARY OF THE INVENTION

The present inventors have recognized the aforementioned difficulties and the need for improved trimming performance and have recognized that it would be possible to move a pod drive in a trimming manner. Further, the present inventors have recognized that it would be desirable to provide a mechanism to allow controlled trim to occur during the operation of a marine vessel in negative and positive trim angles with a pod drive that protrudes through the bottom of a vessel.

In at least some embodiments, a trimmable pod drive assembly is provided that includes a pod drive unit having a transmission assembly secured to a steering unit, a gear case assembly coupled to and rotatable by the steering unit about a steering axis, and a propeller rotatable about a propeller driveshaft axis extending through the gear case assembly so as to generate thrust along a thrust vector. The trimmable pod drive assembly further includes a trim assembly secured to the pod drive unit in a manner allowing for rotation of the pod drive unit about a trim axis that is substantially perpendicular to the steering axis, wherein actuation of at least one component of the trim assembly causes movement of the pod drive unit and the thrust vector about the trim axis.

In at least some other embodiments, a trimmable pod drive assembly configured for use as part of a marine vessel having a vessel bottom is provided that includes a pod drive unit having a gear case assembly coupled to a steering unit, wherein the gear case assembly is positioned substantially below the vessel bottom and the steering unit is positioned substantially above the vessel bottom, and wherein the steering assembly includes a steering axis for rotation of the gear case assembly thereabout and a propeller secured to a propeller driveshaft, the propeller driveshaft extending from the gear case assembly along a propeller centerline and providing a thrust vector that extends along the propeller centerline, wherein the propeller centerline is substantially perpendicular to the steering axis and one or more actuators at least indirectly coupling the pod drive unit to the vessel in a manner such that actuation of the one or more actuators causes a rotation of the thrust vector about a trim axis.

In at least yet some other embodiments, a method of trimming a pod drive unit of a marine vessel is provided that includes providing a pod drive unit that extends through a vessel bottom substantially along a steering axis, pivotably securing the pod drive unit at least indirectly to the vessel so that the pod drive unit is capable of being rotated about a trim axis substantially perpendicular to the steering axis, and actuating one or more actuators at least indirectly linking the vessel with the pod drive unit so as to cause a rotation of the pod drive unit about a trim axis to perform a trim adjustment.

In at least some further other embodiments, a movable pod assembly configured for use as part of a marine vessel having a hull is provided, with the movable pod assembly including a gear case assembly having a torpedo portion, a strut portion, and a transmission portion, the gear case assembly configured to extend downward away from the hull, wherein the torpedo portion includes a torpedo structure, a shaft extending outwardly therefrom, and a propeller supported by the shaft, and wherein the strut portion extends between the torpedo portion and the transmission portion, and wherein the transmission portion is configured to be coupled at least indirectly to the hull, and further wherein at least a portion of the gear case assembly is rotatable about a steering axis and is additionally rotatable about a trim axis. The movable pod assembly can further include, whereby as a first rotational orientation of the hull varies relative to a horizon, a second rotational orientation of the shaft relative to the horizon can be maintained substantially constant. Additionally, the movable pod assembly can include, wherein the trim axis is substantially perpendicular to the steering axis. Further, the movable pod assembly can be installed on a marine vessel or craft. Still further, the movable pod assembly can include, wherein the movable pod assembly is connected or otherwise secured at least indirectly to a hull of the vessel.

In at least some yet further other embodiments, a method of trimming a drive assembly of a marine vessel can be provided that includes articulating, rotating, trimming and/or tilting at least a portion of the drive assembly about a trim axis so as to maximize thrust applied in a direction of propulsion of the vessel. The method can further include, wherein the articulating, rotating, trimming and/or tilting varies an angle of thrust of the drive assembly. Additionally, the method can further include, wherein the articulating, rotating, trimming and/or tilting is accomplished while the vessel is accelerating. Further, the method can further include, wherein the trim axis is substantially perpendicular to the steering axis.

Other embodiments, aspects, features, objectives and advantages of the trimmable pod drive will be understood and appreciated upon a full reading of the detailed description and the claims that follow.

BRIEF DESCRIPTION OF THE DRAWINGS

Embodiments of the trimmable pod drive are disclosed with reference to the accompanying drawings and are for illustrative purposes only. The trimmable pod drive is not limited in its application to the details of construction or the arrangement of the components illustrated in the drawings. The trimmable pod drive is capable of other embodiments or of being practiced or carried out in other various ways. For consistency and ease of understanding, like (but not necessarily identical) components, structures and other items described in accordance with exemplary embodiments of the present disclosure generally share like reference numerals In the drawings.

DETAILED DESCRIPTION OF THE PREFERRED EMBODIMENT

Figure 1:
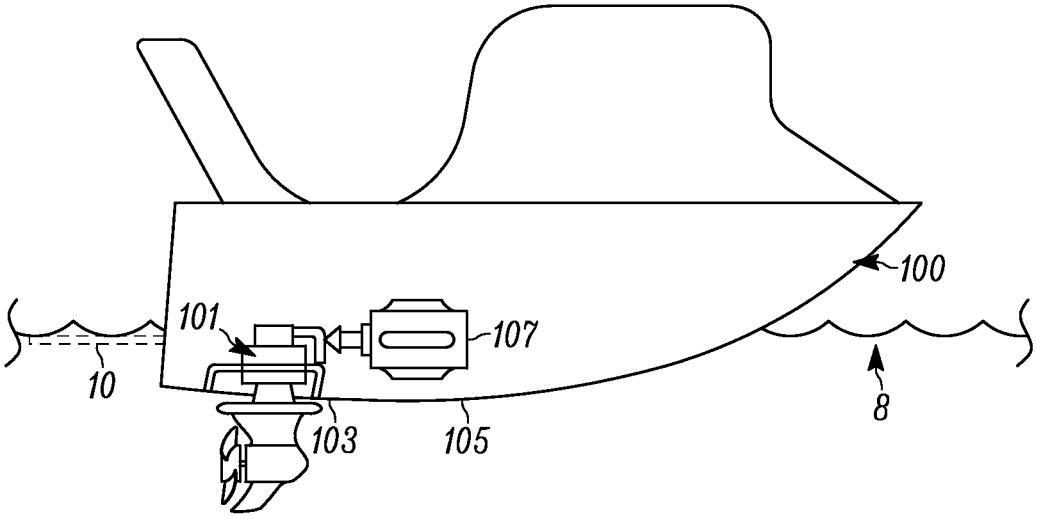
FIG. 1 is a partial cross-sectional side view of an exemplary marine vessel with a trimmable pod drive assembly.

Referring to FIG. 1, a partial cross-sectional side view of an exemplary marine vessel 100 with a trimmable pod drive assembly 101 is provided. The vessel 100 includes a vessel bottom portion 103 for receiving the trimmable pod drive assembly 101 therethrough and a hull 105 extending along the lower portion of the vessel 100. Further, an engine 107 is provided that is coupled to the trimmable pod drive assembly 101. The vessel 100 is depicted floating in a water source 8, having a water surface/level 10 situated above the vessel bottom portion 103.

Figure 2:
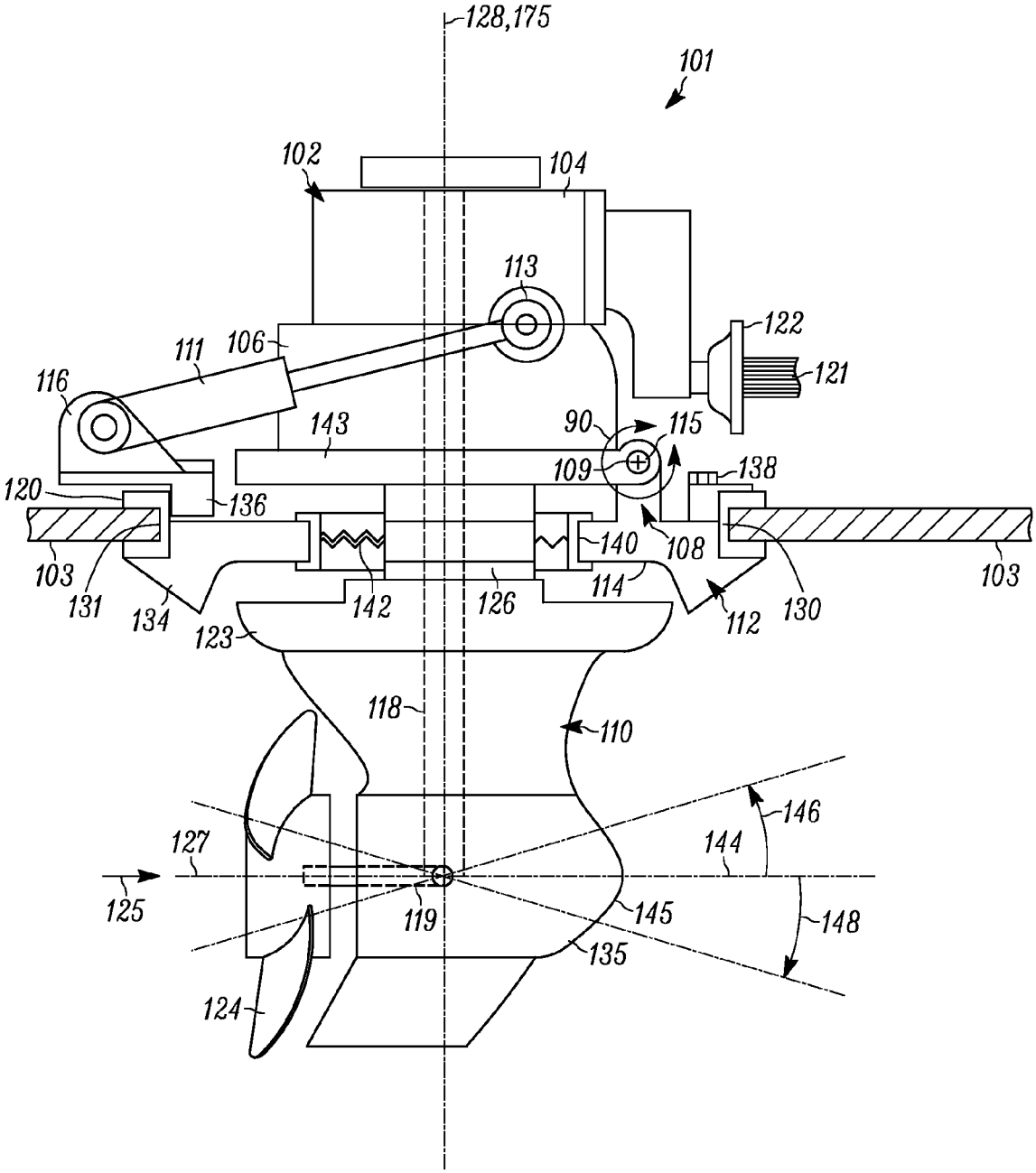
FIG. 2 is a side view of a first exemplary embodiment of a trimmable pod drive assembly.

Referring to FIG. 2, a first embodiment of the exemplary trimmable pod drive assembly 101 is illustrated. The trimmable pod drive assembly 101 includes a pod drive unit 102 and a trim assembly 108. The pod drive unit 102 includes a transmission assembly 104, a steering unit 106, and a gear case assembly 110. The trim assembly 108 can be used to rotate the pod drive unit 102 about a trim axis 109 (point of rotation) using one of a plurality of configurations, to provide a trim or tilt adjustment. Although a further reference to "tilt" is not included, it should be understood that the use of the term "trim" in various forms can include "tilt" (e.g. trim/tilt axis, trim/tilt adjustment, etc.). In general, in at least some embodiments, the trim assembly can merely include components that are at least in part or are in whole, integrally formed with various features of the vessel and/or pod drive unit. Similarly, various specific components described below as included in the various embodiments of the trim assembly can be formed integrally with features of the vessel and/or pod drive unit.

Referring again to FIG. 2, in at least some embodiments, the trim assembly 108 includes one or more trim cylinders 111 and a mounting plate 112, with the mounting plate 112 having one or more front pivot mounts 114 and one or more rear pivot mounts 116. The mounting plate 112 is shown secured to the vessel bottom portion 103, although the mounting plate 112 can also be secured to another portion of the vessel 100, such as a tunnel upper surface (not shown).

The transmission assembly 104 is secured to the steering unit 106 and includes an input flange 122 for coupling to an input shaft 121 from the output of the engine 107 and a vertical output driveshaft coupled to a vertical input driveshaft of the gear case to transfer the engine output power to the gear case assembly 110. The vertical output driveshaft and vertical input driveshaft can be a single shaft or separate coupled shafts, therefore, for simplicity these components are referenced jointly as a vertical driveshaft 118 that includes a longitudinally extending vertical driveshaft centerline 175. The steering unit 106 can be positioned below the transmission assembly 104 and is rigidly secured to a pivot plate 143 and pivotably coupled by a pivot pin 115 to at least one front pivot mount 114, thereby providing the trim axis 109 centered about the pivot pin 115, for the pod drive unit 102 to be rotated during a trim adjustment. The vertical driveshaft 118 extends through the steering unit 106 from the transmission assembly 104 and into the gear case assembly 110. The gear case assembly 110 is configured to redirect the output of the transmission assembly 104 by about 90 degrees to a propeller driveshaft 119. The propeller driveshaft 119 rotates one or more trailing propellers 124 capable of providing a thrust vector 125 directed along a propeller centerline 127 on the torpedo portion 135 of the gear case assembly 110. The propeller centerline 127 (along with the thrust vector 125) is directionally modified by rotating the pod drive unit 102 about the trim axis 109.

The gear case assembly 110 is coupled to the steering unit 106 by a gear case adapter 126, which provides a transition between the steering unit 106 positioned above the vessel bottom portion 103 and the gear case assembly 110 positioned below the vessel bottom portion 103. The gear case adapter 126 includes an adapter plate 123 for interfacing with the steering unit 106 and gear case assembly 110 in a manner that allows the gear case assembly 110 to pivot about a steering axis 128 that is in at least some embodiments, coaxial with the vertical driveshaft 118, for steering the gear case assembly 110 through port and starboard steering angles.

As seen in FIG. 2, the pod drive unit 102 is secured to the vessel bottom portion 103 by the trim assembly 108. A vessel bottom passage 129 is situated along the vessel bottom portion 103 and provides an opening for the pod drive unit 102 to extend through the vessel bottom portion 103. More particularly, in at least some embodiments, the mounting plate 112 is fastened to the vessel bottom passage 129 about a mount outer perimeter 130. The mount outer perimeter 130 can be fastened to the vessel bottom portion 103 using one or more of numerous methods, for example by inserting a grommet style water seal 120 between the vessel bottom portion 103 and the mount outer perimeter 130 and clamping together a lower flanged portion 134 and an upper flanged portion 136 using mounting bolts 138 to compress the water seal 120 and secure the drive assembly 102 to the vessel bottom portion 103.

The mounting plate 112 can further include a mount inner passage 140 for receiving the gear case adapter 126. The mount inner passage 140 is shaped and sized to accommodate movement of the pod drive unit 102, particularly the gear case adapter 126, during rotation of the pod drive unit 102 about the trim axis 109. To prevent the influx of water adjacent to the gear case adapter 126, an adapter seal 142 is secured at least indirectly between the mount inner passage 140 and the gear case adapter 126. In at least some embodiments, the adapter seal 142 is a flexible watertight seal, which allows rotation of the pod drive unit 102 inside the mount inner passage 140.

The trim assembly 108 allows for a trim adjustment that can be utilized to vary the pitch of the vessel 100 during operation of the vessel 100. By varying the pitch, an optimal planing position for the current conditions can be achieved. This is particularly significant, as an optimal planing position can improve fuel economy, reduce acceleration time, reduce wear on the pod drive unit 102 and increase the vessel's top speed. To perform a trim adjustment, the pod drive unit 102 is rotated along the trim axis 109, about arc 90, by extending or retracting the trim cylinder(s) 111 of the trim assembly 108. This extension or retraction of the trim cylinder(s) 111 modifies the angle of the propeller center line 127, and therefore the thrust vector 125, relative to the flow of water normally considered to be along the horizontal 144 at a zero degree trim angle. More particularly, retracting the trim cylinder(s) 111 rotates the pod drive unit 102 about trim axis 109, and raises a nose 145 of a torpedo portion 135 of the gear case assembly 110 towards the vessel bottom portion 103 to generate a negative trim angle 146. This is known as a negative trim. Conversely, extending the trim cylinder(s) 111 rotates the pod drive unit 102 and lowers the nose 145 of the gear case assembly 110 away from the vessel bottom portion 103 and provides a positive trim angle 148. This is known as a positive trim. By utilizing the positive and negative trim adjustments, the trim assembly 108 can change the angle of the thrust vector 125 relative to the vessel bottom portion 103 to achieve optimal planing. Further, it should be noted that the illustrations provided in FIG. 2 to demonstrate the positive and negative trim angles 146, 148 are not illustrative of the actual rotation of the pod drive unit 102, as rotation would occur about the trim axis 109.

Figure 3A:
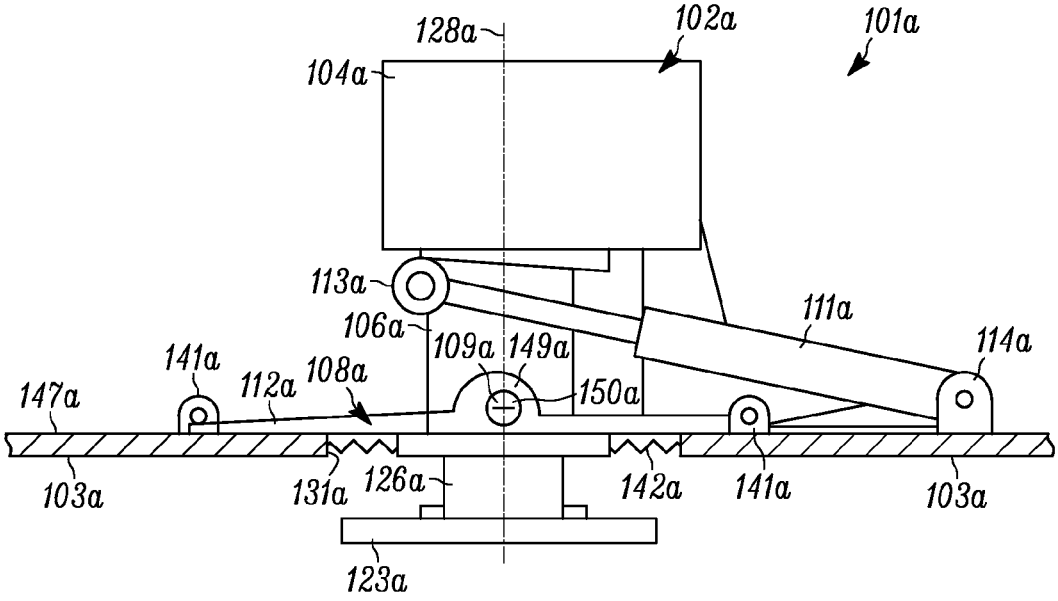
FIG. 3A is a partial side view of a second exemplary embodiment of a trimmable pod drive assembly.
Figure 3B:
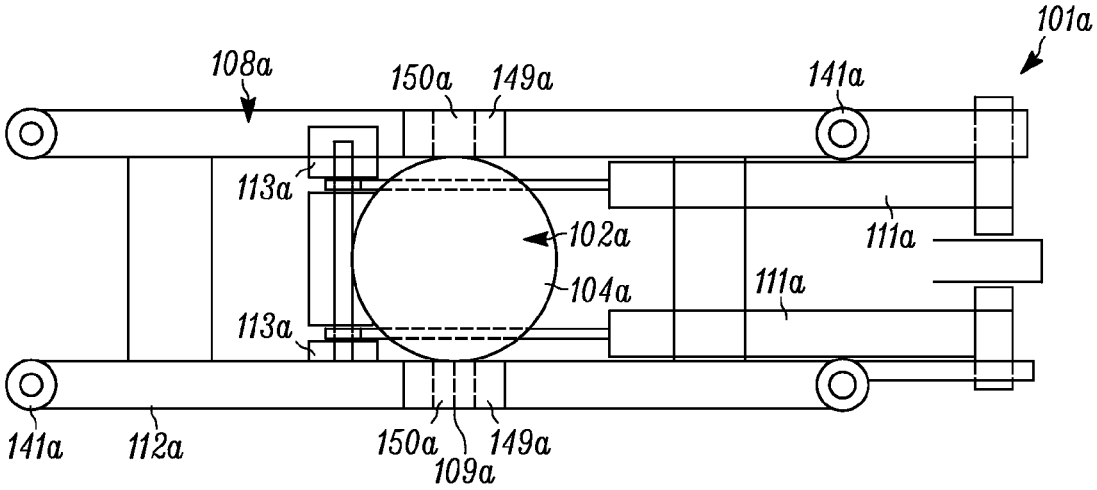
FIG. 3B is a top view of the trimmable pod drive assembly of FIG. 3A.

Referring to FIGS. 3A and 3B, a second embodiment of the exemplary trimmable pod drive assembly 101*a* is illustrated in partial side and top views with a lower portion of the pod drive unit cut-away below 123*a*. As seen in these and other FIGS., by altering the mounting configuration, a trim axis 109*a* can be located about a variety of locations on the trimmable pod drive assembly 101*a*. In this regard, the trim axis 109*a* can be positioned as desired to accommodate specific design constraints. In this second embodiment, the trim axis 109*a* intersects and is perpendicular to a steering axis 128*a*. Similar to the first embodiment, the trim assembly 108*a* is mounted to a vessel bottom portion 103*a*, although a mounting plate 112*a* is fastened on top of an upper surface 147*a* of the vessel bottom portion 103*a* using a plurality of fixed mounts 141*a*. A pair of central pivot mounts 149*a* is provided to receive and support a pair of protrusions 150*a* extending from a steering unit 106*a*, with the trim axis 109*a* being centered about the protrusions 150*a*. One or more front pivot mounts 114*a* extend from the mounting plate 112*a* and secure one or more trim cylinder(s) 111*a* at one end while pivoting mounts 113*a*, which are secured to the steering unit 106*a*, support the other end of the trim cylinder(s) 111*a*. As discussed above, the pod drive unit 102*a* can be rotated about the trim axis 109*a* by actuating the trim cylinder(s) 111*a*.

Figure 4:
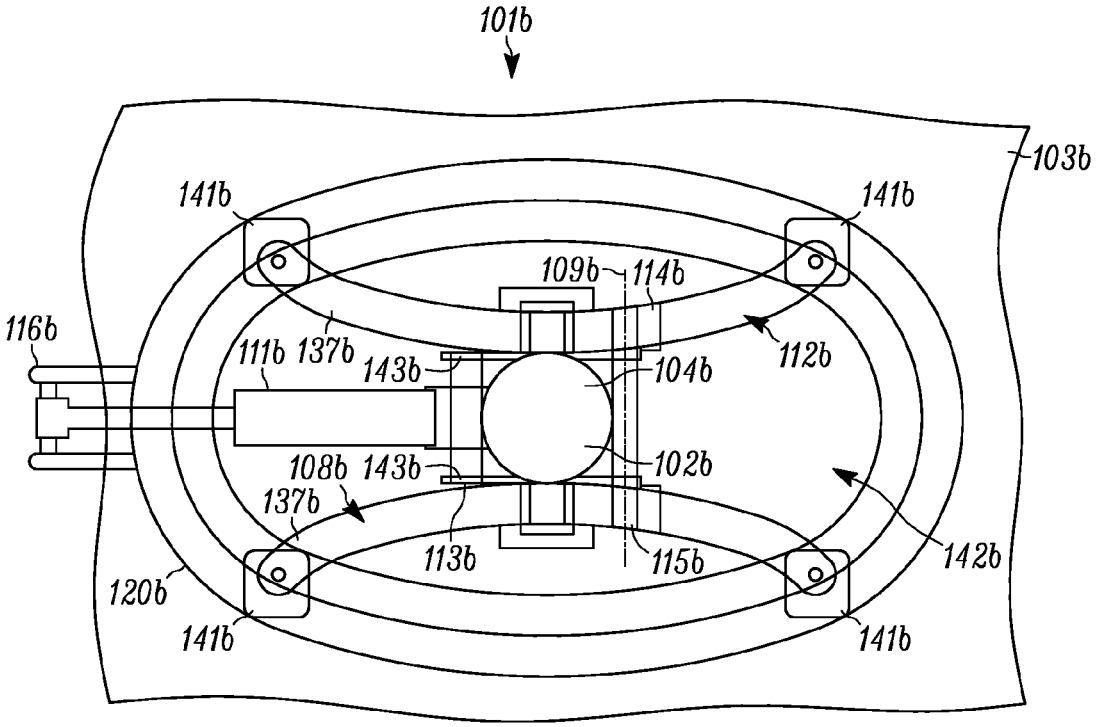
FIG. 4 is a partial top view of a third exemplary embodiment of trimmable pod drive assembly.

Referring to FIG. 4, a third embodiment of an exemplary trimmable pod drive assembly 101*b* is illustrated. In this configuration, a trim assembly 108*b* includes a mounting plate 112*b* includes a pair of arc-shaped supports 137*b* that extend upwards away from a vessel bottom portion 103*b* and inwards toward a steering unit 106*b*. The supports 137*b* are fastened to the vessel bottom portion 103*b* by a plurality of fixed mounts 141*b*. One or more trim cylinder(s) 111*b* is attached at one end to a rear pivot mount 116*b* and at the other end to a pivoting mount 113*b* at the steering unit 106*b*. The steering unit 106*b* can be secured to a pivot plate 143*b*, which is secured to pivot mounts 114*b* on the arc-shaped supports 137*b* by a pivot pin 115*b*. Rotation of a pod drive unit 102*b* is fixed at a trim axis 109*b*, which is centered about the pivot pin 115*b*. The mounting plate 112*b* of this configuration allows for the trim axis 109*b* to be raised a desired distance above the vessel bottom portion 103*b* to accommodate various design criteria.

Figure 5:
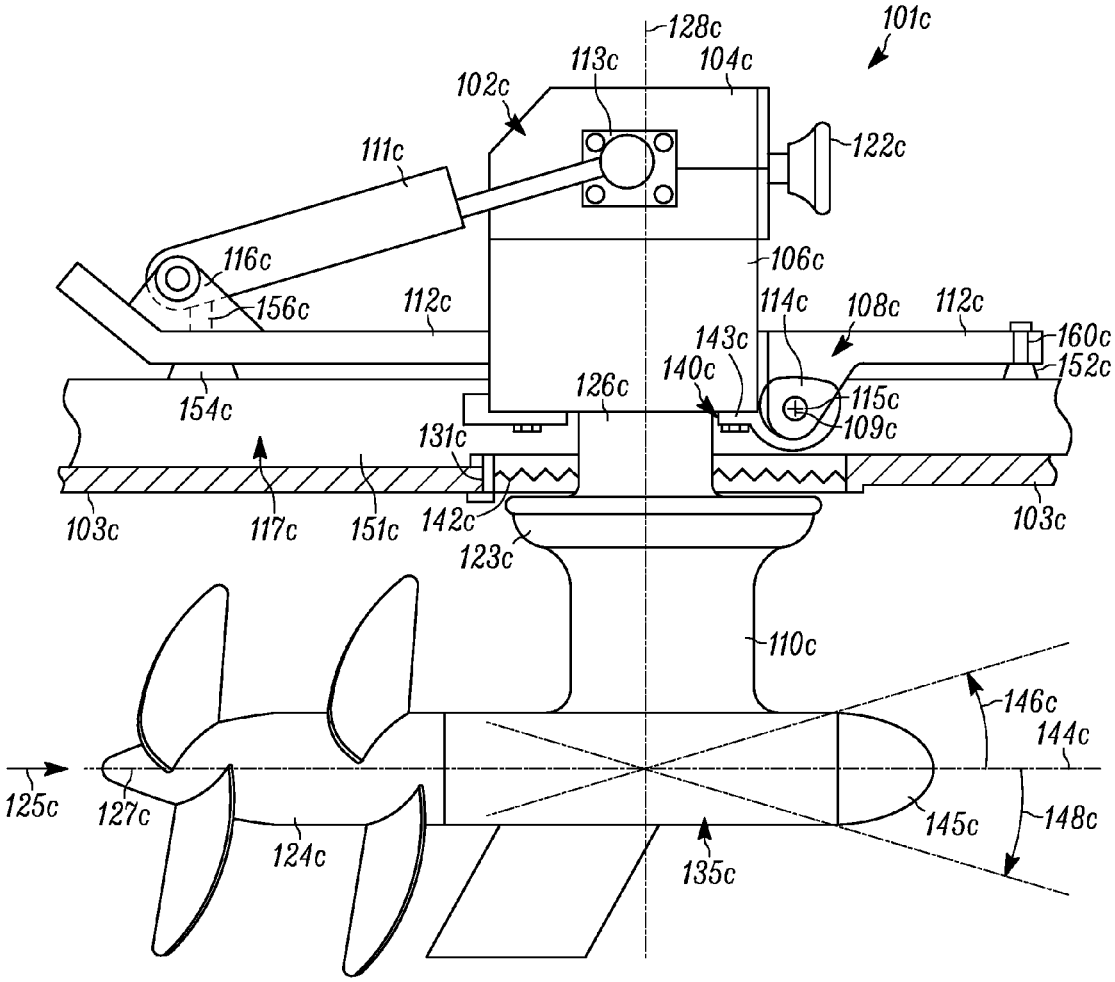
FIG. 5 is a side view of a fourth exemplary embodiment of a trimmable pod drive assembly.

Referring to FIG. 5, a fourth embodiment of an exemplary trimmable pod drive assembly 101*c* is illustrated. As seen in FIG. 5, in at least some embodiments, the trimmable pod drive assembly 101*c* can be secured to a stringer system 117*c*, rather than directly to the vessel bottom portion 103*c*. A stringer system for a marine vessel is well known in the art and includes a series of generally parallel longitudinally disposed stringers positioned in the hull of a vessel along the vessel bottom for strengthening the vessel bottom and for providing a mounting point for power train devices to be fastened to the hull of the vessel without the need to penetrate the vessel bottom.

To secure the trimmable pod drive assembly 101*c* to the stringer system 117*c*, a trim assembly 108*d* includes a mounting plate 112*c* secured to a plurality of mounting blocks, which are secured to the stringers 151*c*. In at least some embodiments, a pair of stringers 151*c* will each have front and rear mounting blocks 152*c*, 154*c* that secure the mounting plate 112*c* to the stringers 151*c*. The mounting blocks can include various configurations that provide securing points, for example one or more posts 156*c* having rubber spacers/insulators (not shown) can be fastened to the stringers 151*c* for interfacing the mounting plate 112*c*. To secure the mounting plate 112*c*, a plurality of posts passages 160*c* situated on the mounting plate 112*c* are provided to receive the posts 156*c*. Securing the mounting plate 112*c* over the posts 156*c* and the rubber spacers/insulators 158*c* can provide a secure and vibration insulated connection to the vessel 100.

Although mounted on the stringer system 117*c*, as opposed to the vessel bottom portion 103*c*, in at least some embodiments the trim assembly 108*c* can be configured substantially similar to the vessel bottom mounted trim assembly 108*b* discussed above with reference to FIG. 2. More particularly, the trim assembly 108*c* includes one or more trim cylinders 111*c* secured to the mounting plate 112*c*, which includes one or more front pivot mounts 114*c* and one or more rear pivot mounts 116*c*. The trim cylinder(s) 111*c* are pivotably fastened to at least one rear pivot mount 116*c* at one end, and to a pivoting mount 113*c* on a pod drive unit 102*c* at the other end. The pivoting mount 113*c* can be fastened to one or more of various components of the pod drive unit 102*c*, such as a steering unit 106*c*, a transmission assembly 104*c*, or a gear case adapter 126*c*. The mounting plate 112*c* further includes the mount inner passage 140*c* that is shaped and sized to accommodate rotation of the pod drive unit 102*c*. A pivot plate 143*c* provides a secure connection to the steering unit 106*c* and is pivotably coupled to one or more front pivot mounts 114*c* by one or more pivot pins 115*c*, thereby providing a fixed trim axis 109*c* centered about the pivot pin 115*c* for the pod drive unit 102*c* to be rotated during a trim adjustment. Further, in the stringer mounted configuration, a vessel bottom passage 131*c* is sized and shaped to accommodate rotation of the pod drive unit 102*c* about the trim axis 109*c* and includes an adapter seal 142*c* secured at least indirectly between the vessel bottom passage 131*c* and a gear case adapter 126*c*. In this configuration, extension or retraction of the trim cylinder(s) 111*c* provides a controlled rotation of the pod drive unit 102*c* about the trim axis 109*c* resulting in a trim adjustment of a thrust vector 125*c*, again as illustrated by trim angles 146, 148 (FIG. 2). Further, in this configuration the thrust vector 125*c* is resolved about the front and rear mounting blocks 152*c*, 154*c* with the thrust therefore passing through and being restrained by the trim cylinder(s) 111*c* and pivot pin(s) 115.

Figure 6:
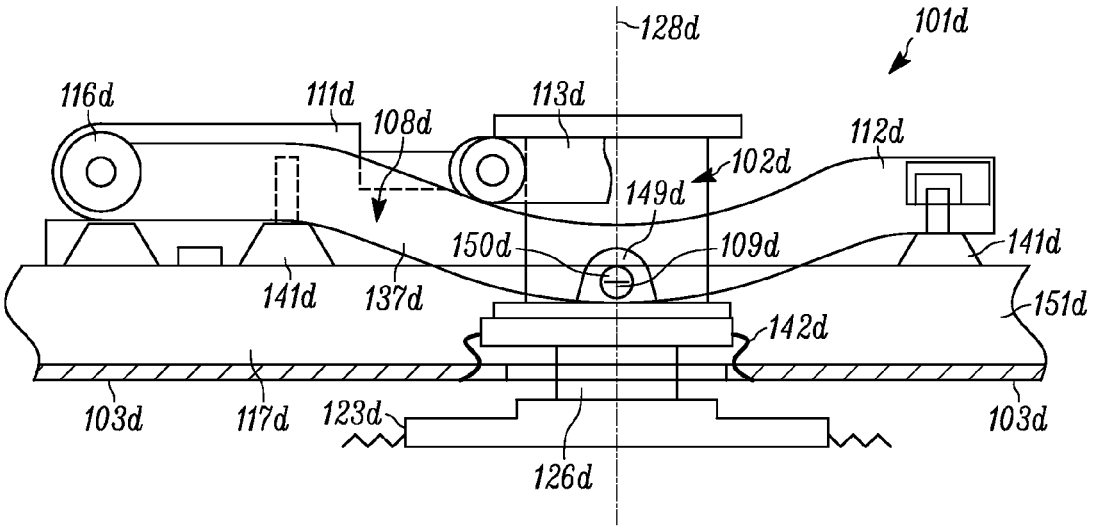
FIG. 6 is a partial side view of a fifth exemplary embodiment of a trimmable pod drive assembly.
Figure 7:
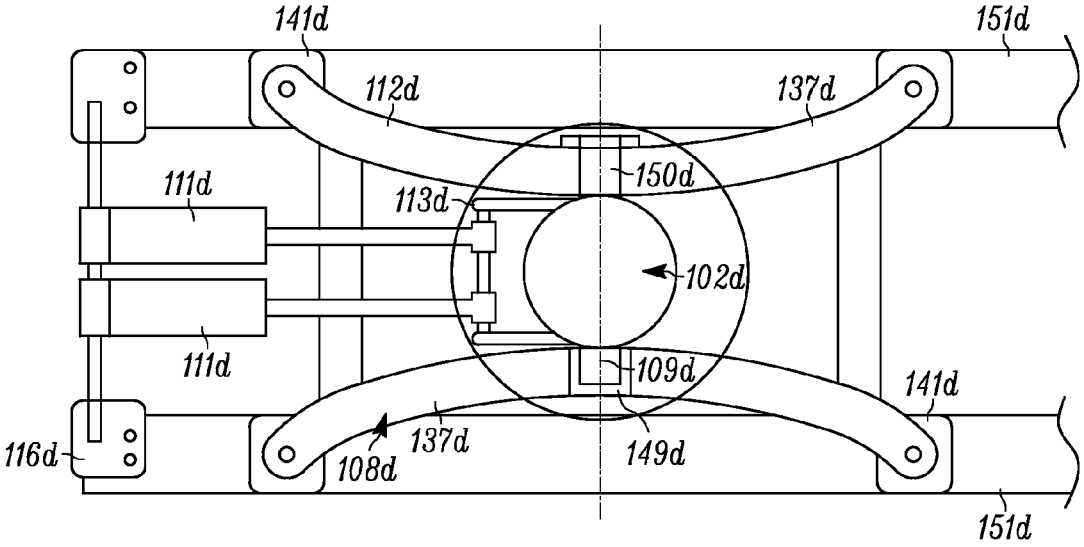
FIG. 7 is a partial top view of the trimmable pod drive assembly FIG. 6.

Referring to FIGS. 6 and 7, a fifth embodiment of an exemplary trimmable pod drive assembly 101*d* is illustrated. A trim assembly 108*d* in this configuration includes a mounting plate 112*d* with a pair of arc-shaped supports 137*d* for supporting a pod drive unit 102*d* on a stringer system 117*d*. The arc-shaped supports 137 extend downward and include central pivot mounts 149*d* for receiving a pair of protrusions 150*d* that extend from a steering unit 106*d*. The protrusions 150*d* provide a trim axis 109*d* about which the pod drive unit 102*d* rotates during a trim adjustment. One or more trim cylinders 111*d* are secured at one end to a pair of rear pivot mounts 116*d* and at the other end to pivoting mounts 113*d* on the pod drive unit 102*d*. In this configuration, the trim axis 109*d* intersects and is perpendicular to a steering axis 128*d*.

Figure 8:
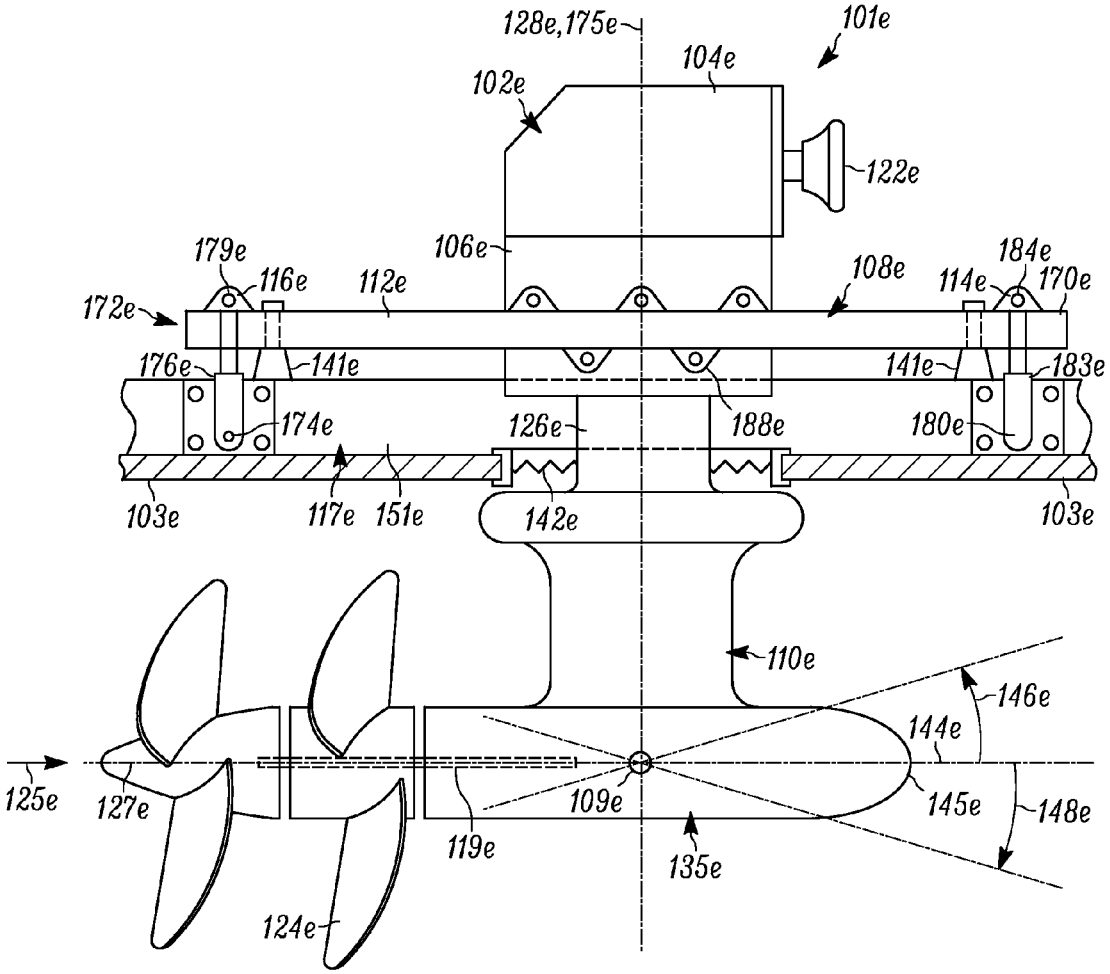
FIG. 8 is a side view of a sixth exemplary embodiment of a trimmable pod drive assembly.

Turning now to FIG. 8, a sixth embodiment of an exemplary trimmable pod drive assembly 101*e* is illustrated. In this configuration, a trim axis 109*e* is no longer fixed in position (static), but instead is variable (i.e., dynamic, having an instant center of rotation). By providing a variably adjustable trim axis 109*e*, the trimmable pod drive assembly 101*e* is significantly more versatile. As seen in FIG. 8, the trim assembly 108*e* includes a mounting plate 112*e* secured to a pod drive unit 102*e* (such as at a steering unit 106*e*) and then supported by mounts 141*e* in a nominal mounting position. Vertically oriented trim cylinders are provided at both a front end 170*e* and a rear end 172*e* of the mounting plate 112*e* to deflect the mounting plate 112*e* from the nominal mounting position. The ability to deflect the mounting plate 112*e* in this manner provides the variably adjustable trim axis 109*e*.

More particularly, rear cylinder bottom ends 174*e* of vertically oriented rear trim cylinders 176*e* are secured to a stringer system 117*e*, and rear cylinder top ends 179*e* of rear trim cylinders 176*e* (one of which is shown) are pivotably coupled to rear pivot mounts 116*e*. In addition, front cylinder bottom ends 180*e* of vertically oriented front trim cylinders 183*e* are pivotably coupled (or in some embodiments, rigidly coupled) to the stringer system 117*e* and front cylinder top ends 184*e* of the front trim cylinders 183*e* are pivotably coupled to front pivot mounts 114*e*. Although not evident from the side view provided in FIG. 8, the trim cylinders 176*e*, 183*e* can be provided on both port and starboard sides of rear and front ends 172*e*, 170*e*, and the mounting plate 112*e* is rigidly secured to a pod drive unit 102*e* about a plurality of fastening points 188*e*. With this configuration, extension or retraction of the cylinders 176*e*, 183*e* can provide similar or differentiated vertical offsets of the mounting plate 112*e*, thereby providing an adjustable trim about a variable trim axis 109*e*. Therefore, positive trim, negative trim, and height adjustment can each be performed on the pod drive unit 102*e*. More particularly, if the front trim cylinders 183*e* are held stationary or retracted while the rear trim cylinders 176*e* are extended, then there will be a forced deflection of the mounts 141*e* and a positive trim angle 148*e* relative to a horizontal 144*e* will be achieved, due to thus providing a positive trim adjustment. In contrast, if the rear trim cylinders 176*e* are held stationary or retracted while the front trim cylinders 183*e* are extended, then a negative trim angle 146*e* will be achieved, and correspondent deflection of the mounts 141*e*, thus providing a negative trim adjustment. Further, if each of the rear trim cylinders 176*e* and the front trim cylinders 183*e* are extended or retracted equally about a horizontal plane, the pod drive unit 102 will be raised or lowered in the water, relative to a vessel bottom portion 103*e*, thereby varying the drafting effect of a gear case assembly 110*e* during operation of the vessel 100.

Further, this configuration allows for an overall height adjustment of a nose 145*e* of the gear case assembly 110*e* (relative to the vessel bottom portion 103*e*) under the water surface 10 (FIG. 1), which can be critical to achieving optimal planing. More particularly, a trim adjustment about a static trim axis can provide for an improved planing position, although when the vessel 100 is loaded or unloaded with accessories, equipment, passengers, fuel, etc., the depth position of the nose 145*e* can vary to a point that optimal planing is unattainable. Therefore, the height adjustment capability of this configuration allows for an advanced level of trim adjustment that can provide increased speed, ride quality, and fuel mileage.

Figure 9:
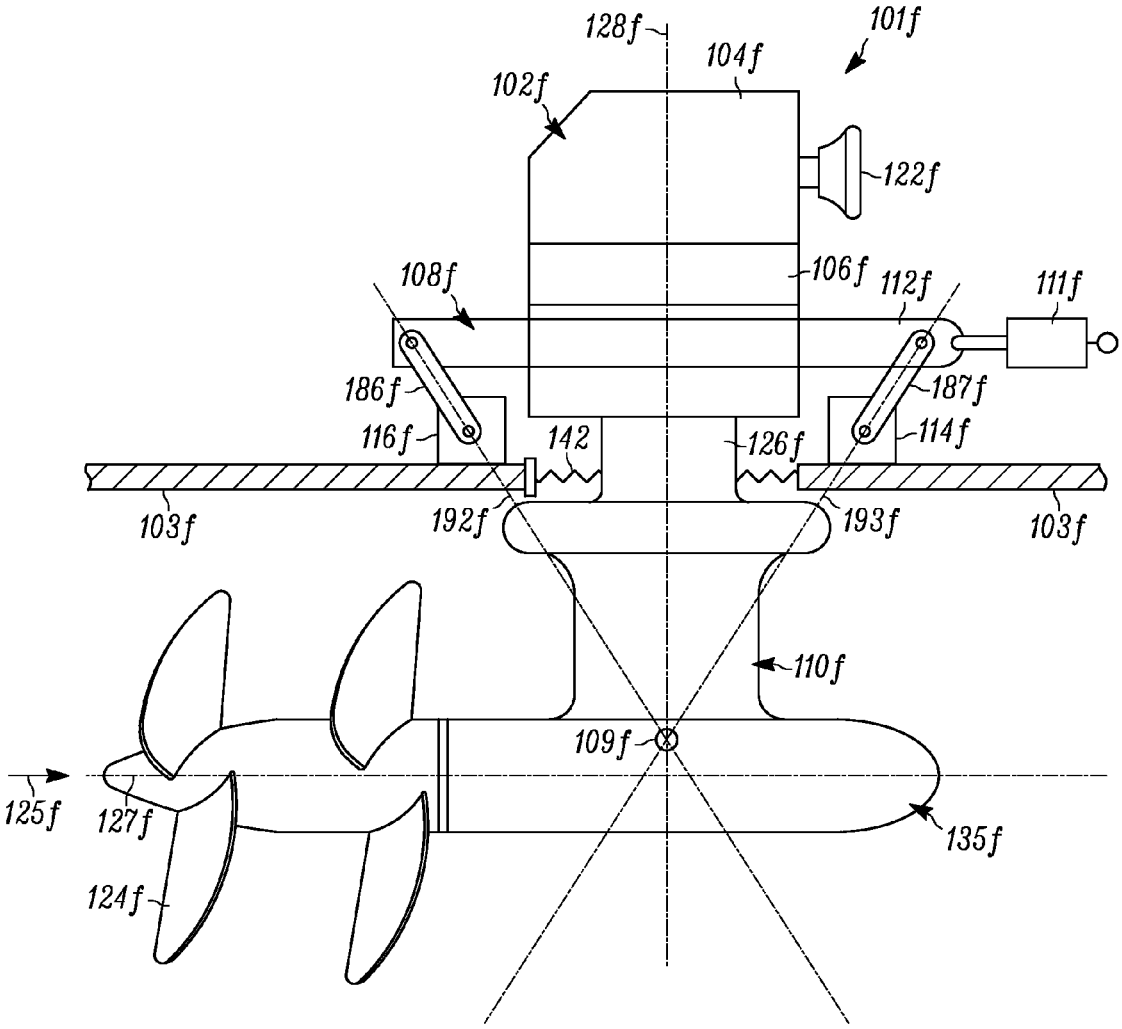
FIG. 9 is a side view of a seventh exemplary embodiment of a trimmable pod drive assembly.

Referring to FIG. 9, a seventh embodiment of an exemplary trimmable pod drive assembly 101*f* is illustrated. In this configuration, a trim assembly 108*f* includes a mounting plate 112*f* secured to a pod drive unit 102*f* and pivotably supported by rear links 186*f* and front links 187*f* (e.g. struts) to front and rear pivot mounts 114*f*, 116*f* on both port and starboard sides of a pod drive unit 102*f*. Further, the mounting plate 112*f* is pivotably secured to the vessel 100 by one or more trim cylinder(s) 111*f*, such that the pod drive unit 102*f* is supported primarily by the links 186*f*, 187*f* and the trim cylinder(s) 111*f*, with the trim cylinder(s) 111*f* governing the pivoting. Additionally, front and rear pivot mounts 114*f*, 116*f* are secured to a vessel bottom portion 103*f*, although in at least some embodiments, the front and rear pivot mounts 114*f*, 116*f* can be secured to a stringer system 117*f*, and/or other portions of the vessel 100. By utilizing the links 186*f*, 187*f*, actuation of the trim cylinder(s) 111*f* provides a trim adjustment with a variable trim axis 109*f*. The trim axis 109*f* is provided at the crossing of a first longitudinal axis 192*f* of the rear links 186*f* and a second longitudinal axis 193 of the front links 187*f*, which is determined by the angles of the links 186*f*, 187*f*. The crossing of the longitudinal axes 192*f*, 193*f* can be chosen by varying the distance between the links 186*f*, 187*f* along the mounting plate 112*f* and/or varying the distance between the front and rear pivot mounts 114*f*, 116*f* along the vessel bottom portion 103*f*, to provide a desired angle, such as about 45 degrees off the horizontal. With this flexibility, the trim axis 109*f* can be centralized about a specific region to satisfy certain design constraints.

Figure 10:
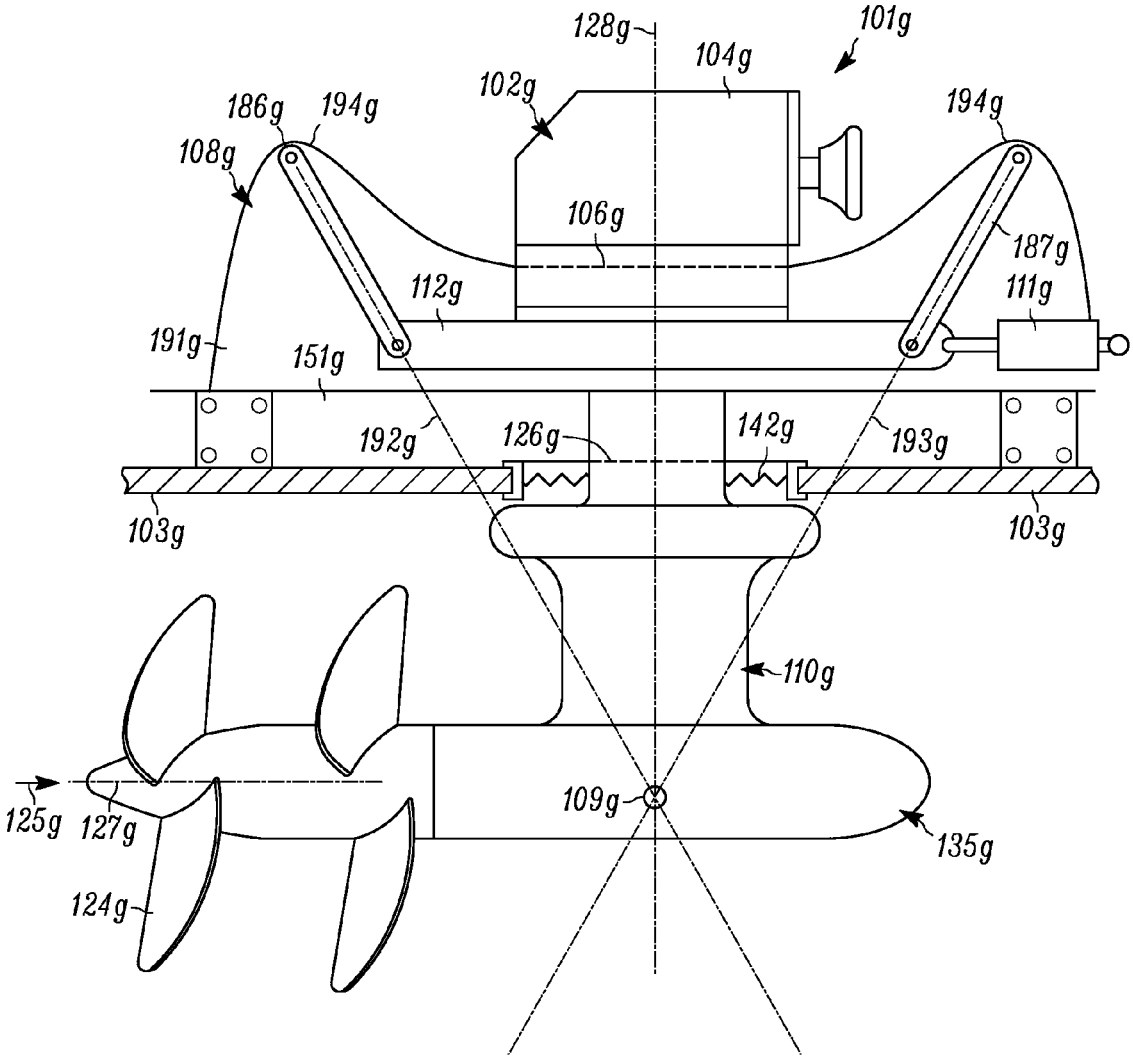
FIG. 10 is a side view of an eighth exemplary embodiment of a trimmable pod drive assembly.

Referring to FIG. 10, an eighth embodiment of an exemplary trimmable pod drive assembly 101*g* is illustrated. In this configuration, a trim assembly 108*g* includes a mounting plate 112*g* being pivotably coupled by a pair of rear links 186*g* and front links 187*g*, to a pair of support plates 191*g* (one on the port side of a pod drive unit 102*g* and one on the starboard side of the pod drive unit 102*g*). The support plates 191*g* can be M-shaped plates that include peaks 194*g*, forward and aft of the pod drive unit 102*g* as shown. Other shaped support plates 191*g* can alternatively be utilized to accommodate numerous potential design criteria. The support plates 191*g* in at least some embodiments are secured to a stringer 151*g* on each side of the pod drive unit 102*g*, although the support plates 191*g* can also be secured to other portions of the vessel 100, such as a vessel bottom portion 103*g* (as shown in FIG. 10). Additionally, the mounting plate 112*g* is secured to the pod drive unit 102*g*, such as at a steering unit 106*g*. The mounting plate 112*g* is further secured to the vessel 100 by one or more trim cylinder(s) 111. The links 186,

187 are pivotably secured to adjacent ones of the peaks 194 of the support plates 191 to support the mounting plate 112. In this manner, the pod drive unit 102 is supported primarily by the links 186, 187 and the trim cylinder(s) 111*g* such that actuation of the trim cylinder(s) 111*g* provides a trim adjustment about a variable trim axis 109*g*, with the trim axis 109*g* provided at the crossing of the longitudinal axes 192*g*, 193*g* of the links 186*g*, 187*g*. As discussed above with reference to FIG. 9, the crossing of the longitudinal axes 192*g*, 193*g* can be selected as desired.

Figure 11:
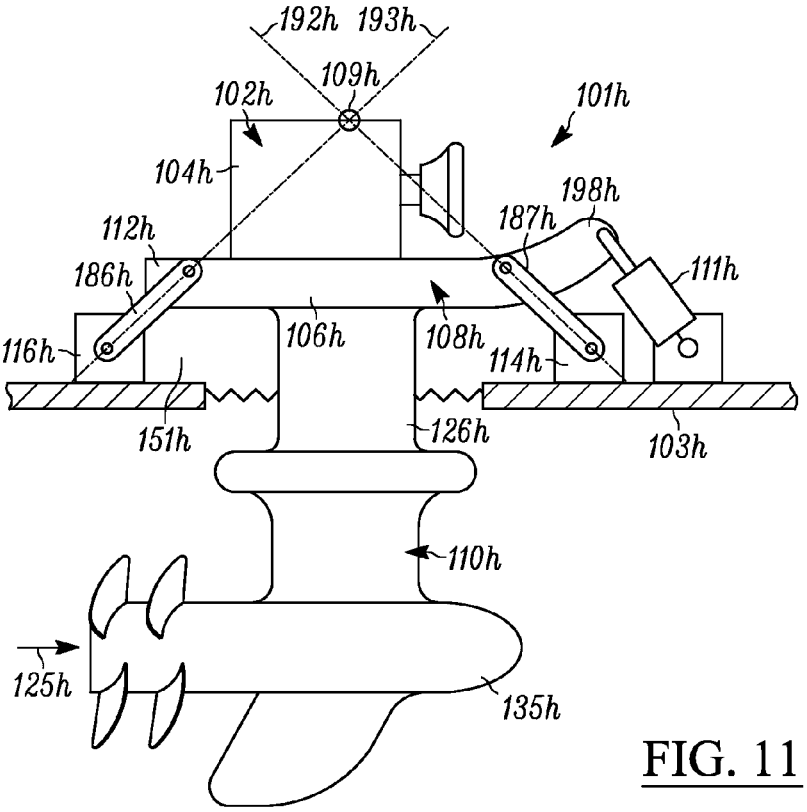
FIG. 11 is a side view of a ninth exemplary embodiment of a trimmable pod drive assembly.

Referring to FIG. 11, a ninth embodiment of an exemplary trimmable pod drive assembly 101*h* is illustrated. In this configuration, a trim assembly 108*h* includes a mounting plate 112*h* being pivotably supported by links 186*h*, 187*h* to front and rear pivot mounts 114*h*, 116*h*, on both sides (port and starboard) of a pod drive unit 102*h*, with the pod drive unit 102*h* secured to the mounting plate 112*h*. Further, the mounting plate 112*h* is pivotably secured to the vessel 100 by one or more trim cylinder(s) 111*h*. In this embodiment, the links 186*h*, 187*h* are each rotated 90 degrees from the respective positions of the links 186*f*, 187*f* in FIG. 9, such that the natural positioning of the links 186*h*, 187*h* is for the links 186*h*, 187*h* to extend upward toward the transmission unit 104*h* rather than away from that unit. Even so, this arrangement provides that the trim axis 109*h* is variable and established above a vessel bottom portion 103*h*. The trim axis 109*h* is provided at the crossing of a first longitudinal axis 192*h* and a second longitudinal axis 193*h* of the links 186*h*, 187*h*, which in this case is above the vessel bottom 103*h*. As discussed above with reference to FIG. 9, the crossing of the longitudinal axes can be selected as desired. Further, the mounting plate 112*h* can include a plate offset 198*h* that angles the trim cylinder(s) 111*h* off the horizontal which, depending on the angle, can move the position of the trim axis 109*h* fore or aft along the vessel 100.

Figure 12:
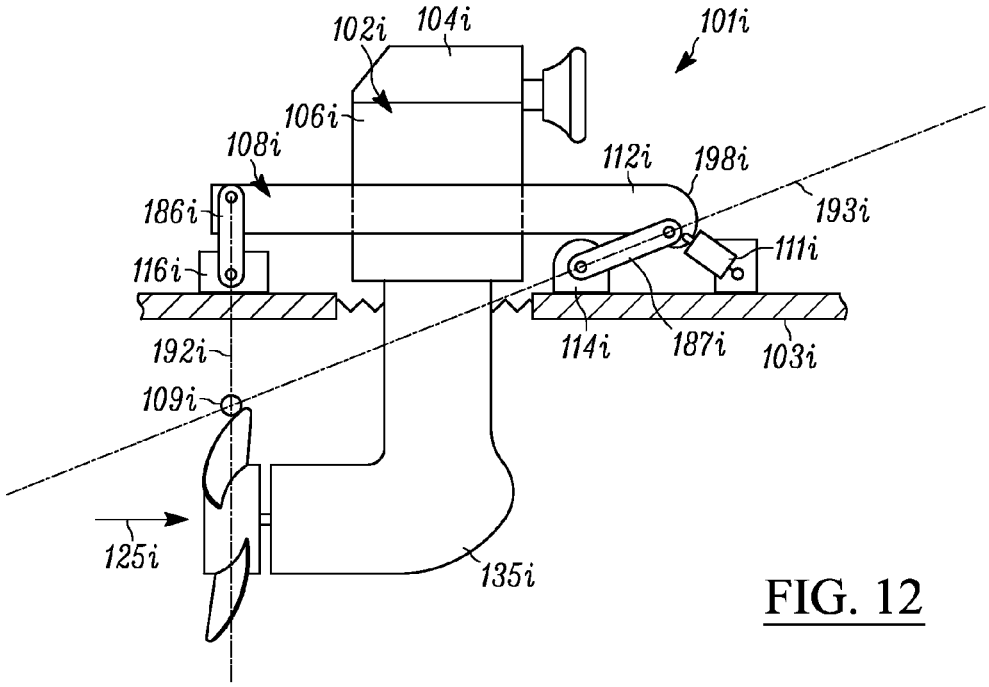
FIG. 12 is a side view of a tenth exemplary embodiment of a trimmable pod drive assembly.

Referring to FIG. 12, a tenth embodiment of an exemplary trimmable pod drive assembly 101*i* is illustrated. In this configuration, a trim assembly 108*i* includes a mounting plate 112*i* being pivotably supported by links 186*i*, 187*i* to front and rear pivot mounts 114*i*, 116*i*, on each side of a pod drive unit 102*i*, with the pod drive unit secured to the mounting plate 112*i*. Further, the mounting plate 112*i* is pivotably secured to the vessel 100 by trim cylinder(s) 111*i*. In this embodiment, a rear link 186*i* is coupled in a vertical position and a front link 187*i* is coupled in an angled position. Similar to the embodiment of FIG. 9, this configuration allows for a trim axis 109*i* that is variable and established below a vessel bottom portion 103*i*. The trim axis 109*i* is provided at the crossing of a first longitudinal axis 192*i* and a second longitudinal axis 193*i* of the links 186*i*, 187*i*. As discussed above with reference to FIG. 9, the crossing of the longitudinal axes 192*i*, 193*i* can be selected as desired. Further, the mounting plate 112*i* can include a plate offset 198*i* that angles the trim cylinder(s) 111*i* off the horizontal which, depending on the angle, can move the position of the trim axis 109*i* fore or aft along the vessel 100.

Figure 13:
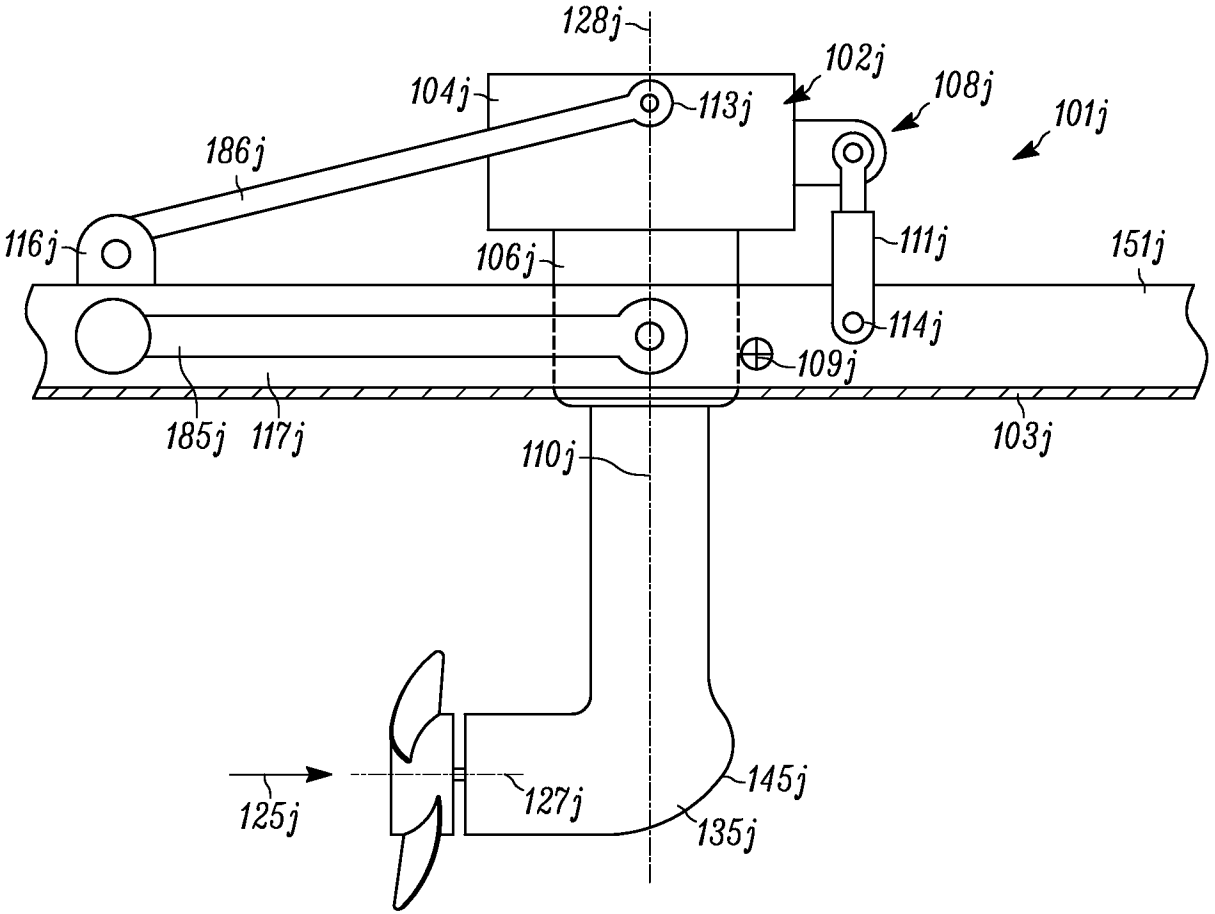
FIG. 13 is a side view of an eleventh exemplary embodiment of a trimmable pod drive assembly.
Figure 14:
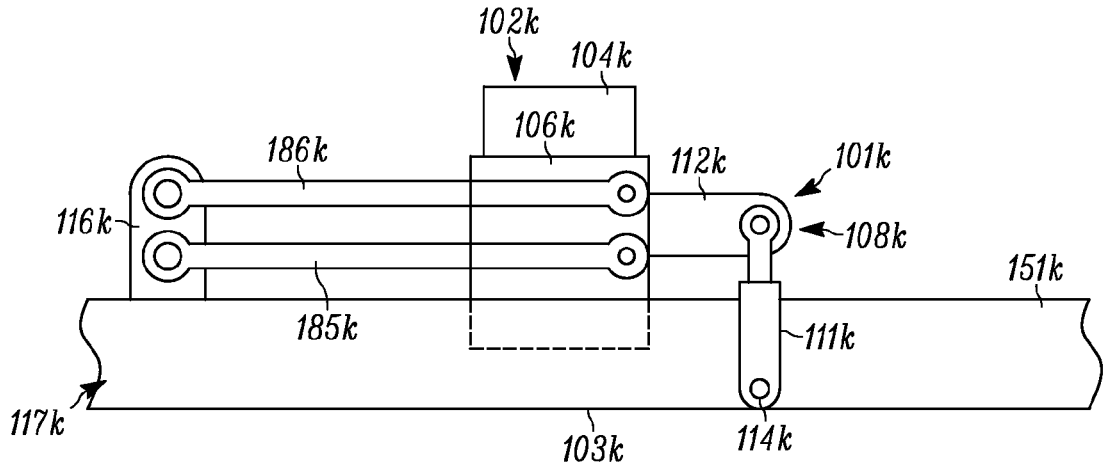
FIG. 14 is a partial side view of a twelfth exemplary embodiment of a trimmable pod drive assembly.
Figure 15:
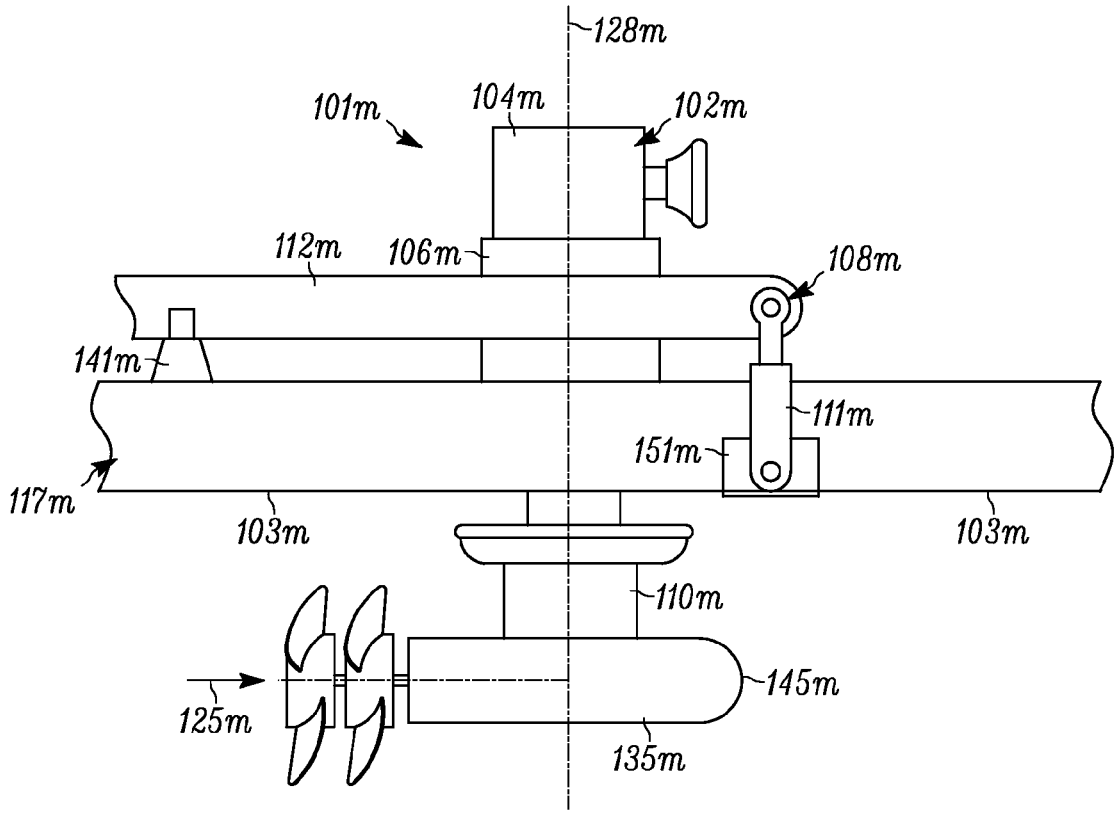
FIG. 15 is a side view of a thirteenth exemplary embodiment of a trimmable pod drive assembly.

The design and configuration of various components described above can be modified to provide additional trimmable pod drive assemblies 101*j*, 101*k*, 101*m* that provide similar or different trim adjustment capabilities. For example, referring to FIGS. 13, 14, and 15, various exemplary combinations of links 186*j*, 186*k*, 186*m*, 187*j*, 187*k*, 187*m* and trim cylinders 111*j*, 111*k*, 111*m* are illustrated. FIG. 13 particularly illustrates a first rear link 185*j* set in a substantially horizontal position and a second rear link 186 set in a substantially angled position, each secured substantially behind a pod drive unit 102. Further, a vertically oriented trim cylinder 111*j* is secured substantially in front of the pod drive unit 102*j* between a front pivot mount 114*j* and the transmission unit 104*j*. This configuration provides a trim variability about a trim axis 109*j*. FIG. 14, by comparison, illustrates an embodiment having a first rear link 185*k* and a second rear link 186*k*, both set in a substantially horizontal position secured substantially behind a pod drive unit 102*k*, with one or more vertically oriented trim cylinders 111*k* secured substantially in front of the pod drive unit 102*k*. Additionally, FIG. 15 illustrates an embodiment in which a pod drive unit 102*m* is secured to a mounting plate 112*m*, with the mounting plate 112*m* secured substantially behind the pod drive unit 102*m* by a mount 141*m* and in front of the pod drive unit 102*m* by one or more vertically oriented trim cylinders 111*m*.

It should be noted that due to the side view nature of the majority of the aforementioned FIGS., various components that were identified have symmetrical counterparts on the opposite side from the view illustrated. For example, components of the trim assembly 108, such as mounts, links, trim cylinders, etc., would typically include symmetrical counterparts to provide support on both sides (port and starboard) of a pod drive unit 102 equally. Therefore, it should be generally understood that in at least some embodiments, although not shown or discussed, symmetrical counterparts for various components are provided on each side of the pod drive unit 102. Alternatively, a single component without a counterpart is provided at a mounting location that substantially bisects the pod drive unit 102 (e.g., in the middle of the vessel) to provide equal loading from the pod drive unit 102 without the need for a counterpart.

Utilizing the aforementioned design points described above, either directly or with modification, the trim axis 109 (e.g., 109*a*, 109*b*, etc.) can be established in the most opportune position to satisfy desired design criteria. Selection of the desired position of the trim axis 109 can be evaluated by taking into consideration several significant points, such as the clearance about the point of rotation, gear case angle versus gear case vertical height, seal dynamics, and input shaft type. Regarding the point of rotation, the trim axis 109 is the point of rotation of the pod drive unit 102 (e.g., 102*a*, 102*b*, etc.), and therefore clearance should be designed to allow the pod drive unit 102 to rotate sufficiently about the trim axis 109. That is, throughout the range of a negative or positive trim adjustment, the pod drive unit 102 should not be allowed to contact the vessel bottom portion 103 (e.g., 103*a*, 103*b*, etc.), a stringer system 117 (e.g., 107*a*, 107*b*, etc.), or other objects not in customary contact with the pod drive unit 102. Similarly, the gear case angle versus gear case vertical height should be contemplated for the same reasons.

Additionally, an adapter seal 142 (e.g., 142*a*, 142*b*, etc.) must accommodate the motion of the gear case assembly 110 (e.g., 110*a*, 110*b*, etc.) at all trim angles without allowing water to enter the bilge. Hence, the vertical and horizontal components of the drive assembly motion should typically be accounted for in the adapter seal's design. Nominal water pressure that is exposed to the vessel bottom portion 103 during operation will simultaneously act on the adapter seal 142 and must also be designed for. Further, the coupling of the input shaft 121 from the engine 107 to the transmission assembly 104 (e.g., 104*a*, 104*b*, etc.), via the input flange 122 (e.g., 122*a*, 122*b*, etc.), is generally achieved with a splined double cardan universal joint that supports parallel offsets, angular offsets, and changes in axial position of the input flange 122 relative to the engine 107. All of these parameters are accentuated with rotation of the pod drive unit 102 about the trim axis 109. The input flange 122 will move vertically and horizontally depending on its location relative to the trim axis 109. This is accounted for with a variable length transmission member to accommodate angular, length, and height changes in position.

Figure 16:
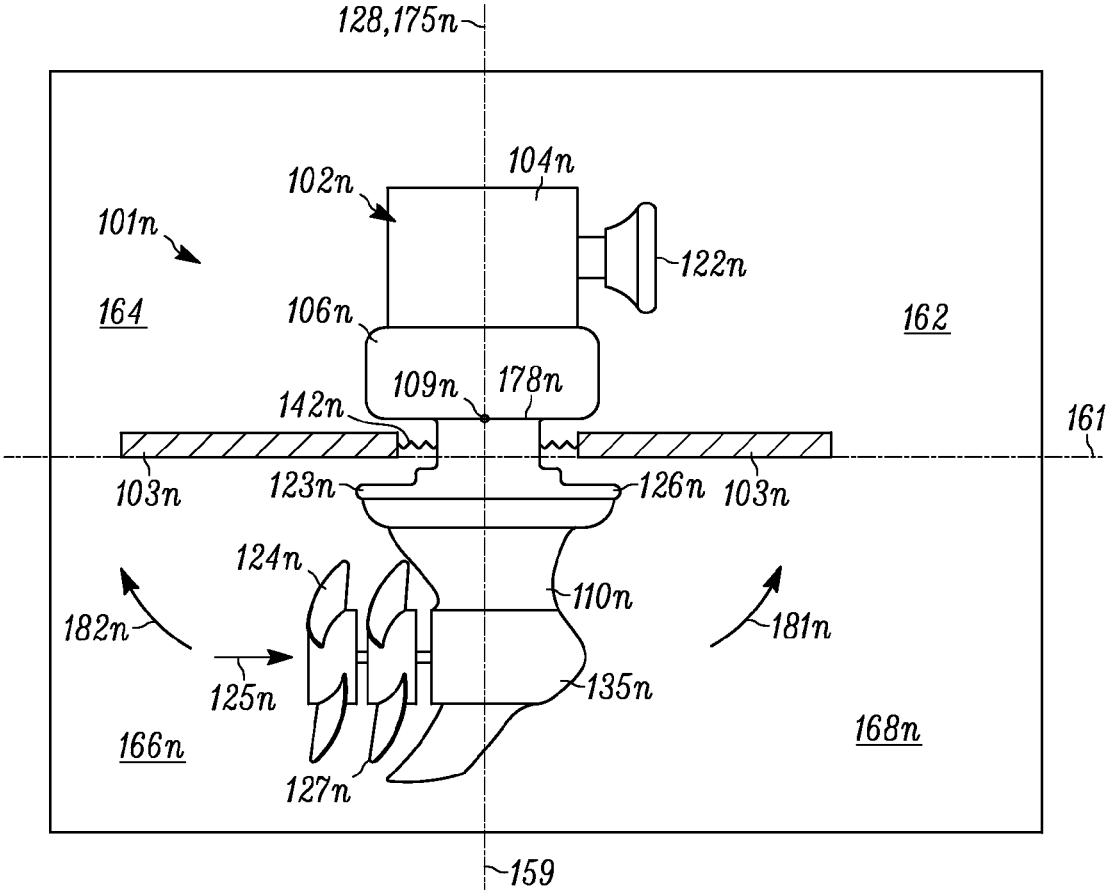
FIG. 16 is a side view of an embodiment of an exemplary trimmable pod drive assembly positioned in a four quadrant diagram.

Given these significant issues of clearance and related motion effects at the propeller 124 (e.g., 124*a*, 124*b*, etc.), the gear case angle/height, the adapter seal 142, and the input flange 122, the designer should typically choose the most suitable location for the trim axis 109. More particularly, to minimize motion about a component, such as the propeller 124, the adapter seal 142, and the input flange 122, the trim axis 109 should be established as close as possible to that component. The positioning of the trim axis 109 is discussed in greater detail with reference to FIG. 16, which identifies four potential quadrants in which the trim axis 109 can be located. Referring thus to FIG. 16, a pod drive unit 102*n* is shown centered along four quadrants that are established by bisecting the pod drive unit 102*n* along a steering axis 128*n* to provide a vertical divide 159 and a horizontal divide 161 is provided along a vessel bottom portion 103*n*. As seen in FIG. 16, this provides a first quadrant 162, a second quadrant 164, a third quadrant 166, and a fourth quadrant 168. Selection of a trim axis 109*n* in relation to (so as to be within one or between different ones of) these quadrants affords a designer the ability to accommodate desired criteria. It should be noted that in general, whether providing a fixed or variable trim axis 109*n*, as long as the trim axis 109*n* becomes (is adjusted to be) located in one of these four quadrants, then rotation will occur around that trim axis substantially similar to a fixed trim axis.

Establishing the trim axis 109*n* in the first quadrant 162 in particular will tend to minimize motion of the engine input shaft, or the flexible seal, depending on the choice of location, as well as maximize motion of the propeller 124*n*. A trim axis 109*n* coincident with a centerline on the face of the input flange 122*n* would result in no linear input shaft motion, only an angular change during trim adjustment. By comparison, placing the trim axis 109*n* in the second quadrant 164 would provide similar motion of a propeller 124*n* and input flange 122*n* with seal motion minimized. Further, the trim axis 109*n* in the third quadrant 166, propeller motion would be minimized, but input flange motion would be maximized. Finally, positioning the trim axis 109 in the fourth quadrant 168 would cause similar but opposite motion as the second quadrant 164 with nearly equal motions of input shaft 121 and propeller positions. With the aforementioned considerations in mind, a designer of a vessel 100 can therefore choose which quadrant best fits the respective requirements for motion of the indicated components.

Figure 18:
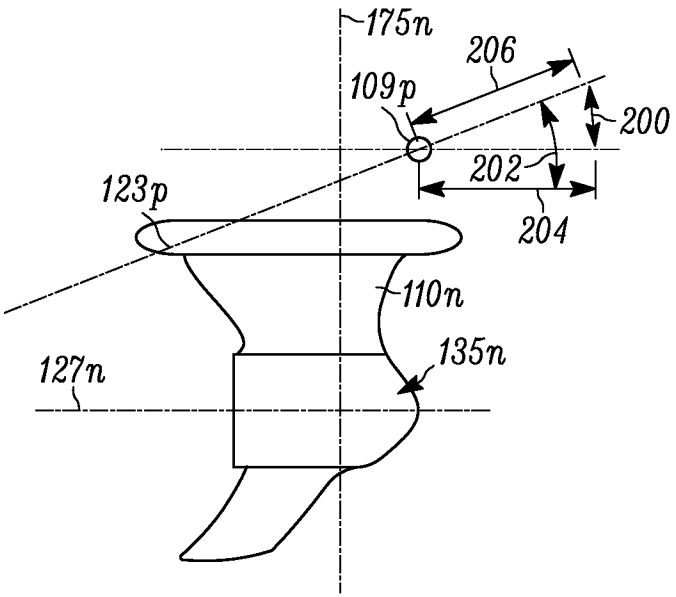
FIG. 18 is a partial side view of an embodiment of an exemplary trimmable pod drive assembly with a trim axis positioned in a first quadrant.
Figure 17:
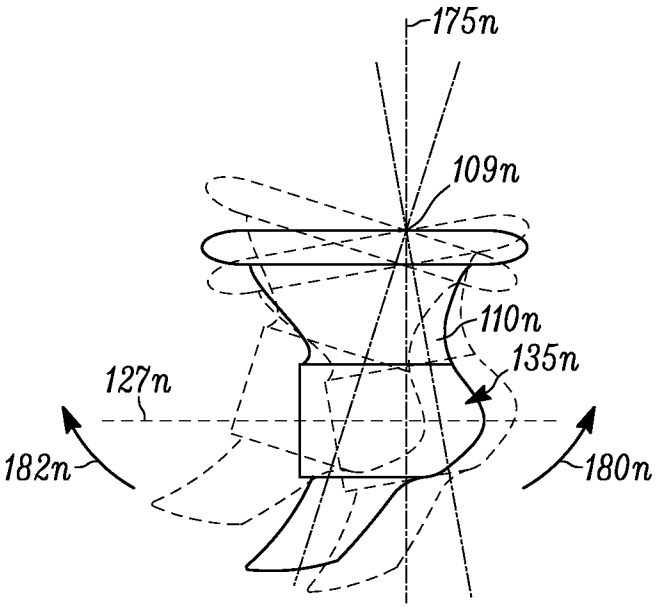
FIG. 17 is a partial side view of an embodiment of an exemplary trimmable pod drive assembly with a trim axis positioned in between a first and second quadrant.
Figure 19:
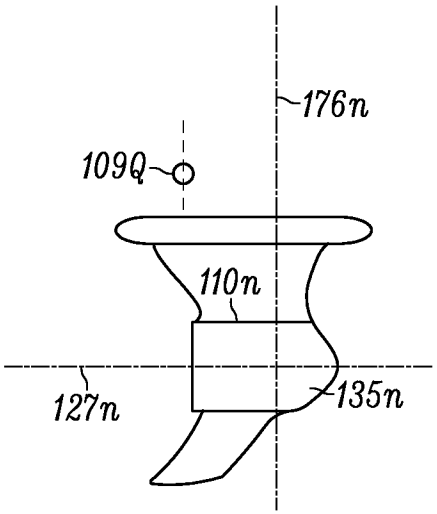
FIG. 19 is a partial side view of an embodiment of an exemplary trimmable pod drive assembly with a trim axis positioned in a second quadrant.

Further illustration of the effects of positioning are discussed with reference to FIGS. 16-19. Consider the trim axis 109*n* located at the intersection of a vertical driveshaft centerline 175*n* and the top of a gear flange 178*n* (as seen in FIGS. 16 and 17), between the first quadrant 162 and the second quadrant 164. In this position, the pod drive unit 102*n* will experience forward rotation 181 of a gear case assembly 110*n* during a negative trim adjustment and an aft rotation 182 for a positive trim adjustment, both with only a minimal vertical height change (along a vertical driveshaft centerline 175*n*) of the pod drive unit 102*n*, as illustrated (in dashed lines) in FIG. 17. By contrast, as seen in FIG. 18, if a trim axis 109*p* is chosen forward of the gear case assembly 110*n*, such as fully in the first quadrant 162, then the resultant rotational change (trim angle 202 from horizontal) will be accompanied by a vertical distance change 200, the vertical distance change 200 equaling the sine of the trim angle 202 multiplied by the distance 206 the trim axis 109*p* was moved forward of the vertical driveshaft centerline 175*n*. Similarly, the horizontal distance change 204 equals the cosine of the trim angle 202 multiplied by the distance 206 the trim axis 109*p* was moved forward of the vertical driveshaft centerline 175*n*. If the trim axis 109*p* is moved rearward fully into the second quadrant, identified as trim axis 109*q*, as seen in FIG. 19, the opposite vertical effect will be observed to the same magnitude governed by the sine of the trim angle 202 by the distance 206 moved aft. For reference, it can be noted that the embodiments shown in FIGS. 9 and 10 illustrate a trim axis 109*f*, 109*g* positioned in between the third quadrant 166 and the fourth quadrant 168. In addition, the configuration illustrated in FIG. 11 provides a trim axis 109*h* positioned in the first quadrant 162, and the configuration illustrated in FIG. 12 provides a trim axis 109*i* positioned in the third quadrant 166.

Figure 20:
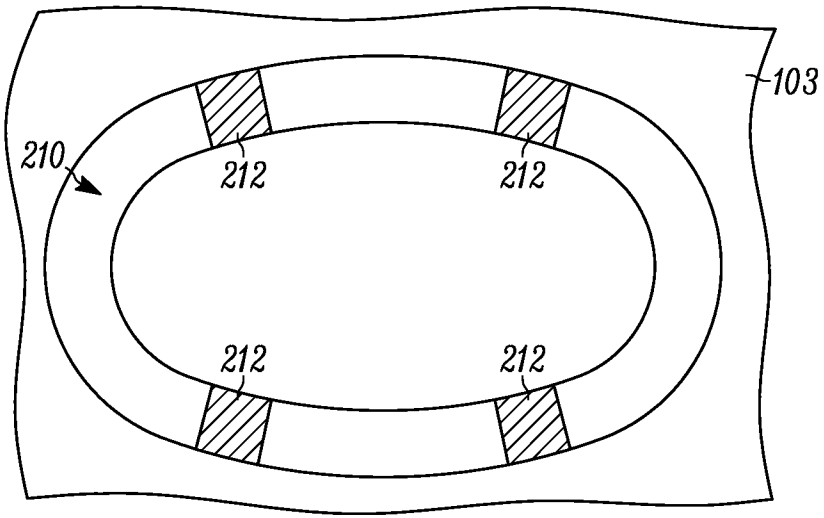
FIG. 20 is a top view of an exemplary grommet seal.

Referring to FIG. 20, a top view of a compound active grommet is provided. When mounting the pod drive unit 102 (e.g., 102*a*, 102*b*, etc.) to a vessel bottom portion 103 (e.g., 103*a*, 103*b*, etc.), a water seal 120 (e.g., 102*b*, etc.) is subject to thrust and steering forces having high amplitudes that require the water seal's stiffness to be relatively high, yet also allow for a trim adjustment to be performed. Additionally, the water seal 120 must be flexible enough to be held tight and continuous against the vessel bottom portion 103 to provide an effective water seal. In order to accommodate both functions, a compound active grommet seal 210 can be provided as the water seal 120. The compound active grommet seal 210 extends longitudinally in line with the vessel length, and includes a provision to minimize motion or distortion due to steering loads. More particularly, the seal 210 includes a plurality of high proximal stiffness portions 212 positioned for lateral stiffness for steering moments (for example, as shown in FIG. 20) but with longitudinal or vertical "softness" for thrust reactions or for trim motion in the vertical and horizontal directions. This type of seal 210 can be utilized to affect water sealing and transmit steering loads, but allow also trim displacements in the vertical and horizontal planes.

Although numerous configurations have been illustrated and described, the various connection points for components shown should be understood to be modifiable to connect to other adjacent surfaces to accommodate various design criteria in other embodiments. In addition, the lengths, shapes, and mounting angles of the various links, mounts, and trim cylinders are considered modifiable to satisfy various design criteria depending upon the embodiment. Further, it should be understood that the various mounts can be varied depending upon the embodiment to accommodate the necessary mounting points, (e.g. vessel bottom, stringers, etc.), as well as to allow for rigid or pivotable connections. Additionally, some or all of the mounts used for coupling the trim assembly (or components thereof) to the vessel and pod drive unit can be separately fastened to or formed integrally with the vessel and pod drive unit. In addition, to accommodate specific design criteria, connections described as rigid or pivotably connected can be either rigid or pivotably connected as required to satisfy the design criteria depending upon the embodiment. In general, various minimal components such as insulators and fasteners may not been illustrated or described, although they can be understood to be included in some embodiments if needed. Further, various components such as actuators (trim cylinders), can be actuated using one of a plurality of sources, such as electric motors, hydraulic pressure, etc. Also, the necessary controls and interconnections (e.g., electrical/hydraulic lines) for the trimmable pod drive assembly have not been discussed herein, although it should be understood that the various components for controlling and monitoring the assembly (e.g., processor, display interfaces, limit switches, etc.) can be provided as necessary.

It is specifically intended that the embodiments provided herein not be limited to the descriptions and illustrations contained herein, but include modified forms of those embodiments, including portions of the embodiments and combinations of elements of different embodiments as come within the scope of the following claims.

We claim:

1. A trimmable pod drive assembly comprising:

a pod drive unit having a transmission assembly secured to a steering unit;

a gear case assembly coupled to and rotatable by the steering unit about a steering axis;

a propeller rotatable about a propeller driveshaft axis extending through the gear case assembly so as to generate thrust along a thrust vector; and a trim assembly secured to the pod drive unit in a manner allowing for rotation of the pod drive unit about a trim axis, wherein actuation of at least one component of the trim assembly causes movement of the pod drive unit and the thrust vector about the trim axis, wherein the trim assembly includes a mounting plate secured adjacent to a bottom of a vessel, and the pod drive unit is pivotably secured to the mounting plate to provide the trim axis for rotation of the pod drive unit, and wherein the pod drive unit is pivotably secured to an actuator that is positioned above the bottom within the vessel and that is actuatable to provide rotation of the pod drive unit about the trim axis.

2. The trimmable pod drive assembly of claim 1, wherein the pod drive unit is at least indirectly secured to the vessel by way of the trim assembly, and wherein the movement of the thrust vector during operation of the vessel provides at least one of a negative trim adjustment or a positive trim adjustment that is capable of modifying a pitch of the bottom of the vessel relative to a water surface.

3. The trimmable pod drive assembly of claim 2, wherein the steering unit and gear case assembly are coupled via a gear case adapter that extends at least partially through a bottom passage of the vessel.

4. The trimmable pod drive assembly of claim 3, wherein the at least one positive or negative trim adjustment is performable at all times or substantially all times during operation of the vessel.

5. The trimmable pod drive assembly of claim 3, wherein the transmission assembly includes an input component directed towards a front of the vessel for receiving an input shaft from an engine positioned forward of the pod drive unit within the vessel, and wherein engine output is directed towards a rear of the vessel and the trim axis is substantially perpendicular to the steering axis.

6. The trimmable pod drive assembly of claim 1, wherein the trim assembly includes a pivot plate secured to the pod drive unit and the mounting plate, and wherein the trim axis is provided at a juncture of the pivot plate and mounting plate.

7. The trimmable pod drive assembly of claim 1, wherein the mounting plate secured to the pod drive unit has a first mount end and a second mount end, with the first mount end and second mount end secured at least indirectly to the vessel by at least one of a trim cylinder, a link, a strut, and as mount.

8. The trimmable pod drive assembly of claim 7, wherein the first mount end and second mount end are each secured to the vessel so as to provide a variable trim axis for rotation of the pod drive unit.

9. The trimmable pod drive assembly of claim 8, wherein the first mount end and second mount end are each additionally secured to the vessel by mounts that are fastened to a stringer system adjacent the bottom.

10. The trimmable pod drive assembly of claim 9, wherein the actuator is actuatable to provide rotation of the thrust vector about the trim axis.

11. The trimmable pod drive assembly of claim 2, further including a compound active grommet seal positioned between the mounting plate and the bottom to affect water sealing and transmit steering loads from the steering unit, while allowing rotation of the gear case assembly about the trim axis, wherein the seal includes a plurality of high proximal stiffness portions positioned for lateral stiffness during steering moments and longitudinal or vertical flexibility for accommodating thrust vector forces and trim adjustments.

12. A marine vessel comprising the trimmable pod drive assembly of claim 1, and further comprising an engine for supplying rotational power to the trimmable pod drive assembly and means for controlling the actuation of the at least one component of the trim assembly.

13. A trimmable pod drive assembly configured for use as part of a marine vessel having a vessel bottom, the trimmable pod drive assembly comprising:

a pod drive unit having a gear case assembly coupled to a steering unit, wherein the gear case assembly is positioned substantially below the vessel bottom and the steering unit is positioned substantially above the vessel bottom, and wherein the steering assembly includes a steering axis for rotation of the gear case assembly thereabout;

a propeller secured to a propeller driveshaft, the propeller driveshaft extending from the gear case assembly along a propeller centerline and providing a thrust vector that extends along the propeller centerline, wherein the propeller centerline is substantially perpendicular to the steering axis; and one or more actuators at least indirectly coupling the pod drive unit to the vessel in a manner such that actuation of the one or more actuators causes a rotation of the thrust vector about a trim axis, wherein the one or more actuators are positioned above the bottom of the vessel within the vessel.

14. The trimmable pod drive assembly of claim 13 wherein rotation of the thrust vector during operation of the vessel provides one of a negative trim or positive trim adjustment that modifies a pitch of the vessel bottom relative to the surface of the water, and wherein the one or more actuators includes a first actuator selected from the group consisting of a hydraulic cylinder and an electric motor.

15. A method of trimming a pod drive unit of a marine vessel comprising:

providing a pod drive unit that extends through a vessel bottom substantially along a steering axis;

pivotably securing the pod drive unit at least indirectly to the vessel so that the pod drive unit is capable of being rotated about a trim axis substantially perpendicular to the steering axis; and actuating one or more actuators at least indirectly linking the vessel with the pod drive unit so as to cause a rotation of the pod drive unit about a trim axis to perform a trim adjustment, wherein the one or more actuators are positioned above the bottom of the vessel within the vessel.

16. The method of claim 15, wherein the actuating of the one or more actuators during acceleration of the vessel modifies a pitch of the vessel bottom relative to a level of water within which the vessel is positioned.

17. The method of claim 16, further comprising providing a trim assembly including a mounting plate, wherein the mounting plate is at least indirectly coupled to the vessel in a pivotal manner by way of the one or more actuators and one or more a link and a support mount, so that a location of the trim axis relative to the vessel bottom is variable.

* * * * *